US009732581B2

(12) United States Patent
Morehead

(10) Patent No.: US 9,732,581 B2
(45) Date of Patent: Aug. 15, 2017

(54) PACKER WITH ANTI-EXTRUSION BACKUP SYSTEM

(71) Applicant: Parker-Hannifin Corporation, Cleveland, OH (US)

(72) Inventor: Mason Morehead, Spartanburg, SC (US)

(73) Assignee: Parker-Hannifin Corporation, Cleveland, OH (US)

( * ) Notice: Subject to any disclaimer, the term of this patent is extended or adjusted under 35 U.S.C. 154(b) by 331 days.

(21) Appl. No.: 14/601,643

(22) Filed: Jan. 21, 2015

(65) Prior Publication Data

US 2015/0204159 A1 Jul. 23, 2015

Related U.S. Application Data

(60) Provisional application No. 61/930,536, filed on Jan. 23, 2014.

(51) Int. Cl.
*E21B 33/12* (2006.01)
*E21B 33/127* (2006.01)

(52) U.S. Cl.
CPC ..... *E21B 33/1216* (2013.01); *E21B 33/12* (2013.01); *E21B 33/127* (2013.01)

(58) Field of Classification Search
CPC ..... E21B 33/1216; E21B 33/12; E21B 33/127
See application file for complete search history.

(56) References Cited

U.S. PATENT DOCUMENTS 4,753,444 A * 6/1988 Jackson ..... C08K 7/06 166/120
5,165,703 A * 11/1992 Morvant ..... E21B 33/1208 277/342
5,615,896 A * 4/1997 Morvant ..... F16J 15/166 277/530
5,676,384 A * 10/1997 Culpepper ..... E21B 33/1216 277/342
6,497,416 B1 * 12/2002 Morvant ..... F16J 15/166 277/584
7,661,471 B2 2/2010 Murray et al.
7,806,193 B2 10/2010 Berzin et al.
7,938,176 B2 * 5/2011 Patel ..... E21B 33/1216 166/187
2006/0272806 A1 12/2006 Wilkie et al.

* cited by examiner

*Primary Examiner* — Yong-Suk (Philip) Ro
(74) *Attorney, Agent, or Firm* — Renner, Otto, Boisselle & Sklar, LLP

(57) ABSTRACT

A well bore packer includes a packer element and an anti-extrusion backup system disposed on a mandrel and located within a well bore wall. Packer element includes longitudinally spaced end regions and a central region. The backup system includes an anti-extrusion device adjacent each of the end regions. The devices each include a collar and a flexible wire mesh mat. The packer element and devices have a smaller diameter configuration before the packer element is expanded. When the packer element is expanded to seal its central region against the well bore wall, the expansion of the packer element activates or deploys the devices and expands the mats to reach between the mandrel and the wall to resist longitudinal extrusion of the packer element.

18 Claims, 4 Drawing Sheets

PACKER WITH ANTI-EXTRUSION BACKUP SYSTEM

RELATED APPLICATIONS

This application claims the benefit of U.S. Provisional Application No. 61/930,536 filed Jan. 23, 2014, which is hereby incorporated herein by reference.

TECHNICAL FIELD

This invention relates to a well bore packer. More specifically, this invention relates to a well bore packer having a packer element and a backup system that resists extrusion of the packer element.

BACKGROUND OF THE INVENTION

Subterranean (including subsea) cased and open well bores are conventionally known and widely used for a variety of purposes, including but not limited to geothermal well bores or well bores that provide access to liquid or gaseous hydrocarbons or other deposits. Packers are conventionally known and are widely used in well bores to provide zonal isolation, well sealing, general mandrel to wall sealing and other applications.

Packers generally include an elongated elastomeric packer element that may be carried on a mandrel. The packer element has a first or reduced diameter configuration in which the outer peripheral surface of the packer element is spaced from the well bore wall to permit positioning of the packer element and mandrel in the well bore. The packer element also has a second or enlarged diameter configuration in which the outer peripheral surface of the packer element seals against the well bore wall and between the well bore wall and the mandrel.

Packer elements may be non-swellable or swellable. Non-swellable packer elements may be changed from their first configuration to their second configuration by an external force such as a fluid pressure acting on the interior of the packer element or axial forces that longitudinally compress the packer element and cause it to expand radially so that the outer peripheral surface of the packer element seals against the well bore wall. Swellable packer elements are changed from their first configuration to their second configuration by exposure of the material of the packer element to a swelling fluid after the mandrel and swellable packer element are positioned in the well bore. Once the non-swellable or swellable packer element has changed to its enlarged diameter configuration, the packer element seals between the mandrel and the cased or open well bore wall to provide a high pressure and high temperature seal.

In the use of well bore packer elements, the sealing pressure of the packer element against the well bore wall and the axial length of the packer element are significant factors in determining the sealing characteristics of the packer element. Longitudinally longer packer elements may increase the sealing characteristics by increasing the sealing area, but longer packer elements can be more difficult to produce, ship and maneuver down a well bore. Increased sealing pressure of the packer element against the well bore wall created by swelling may increase the sealing characteristics, but increased sealing pressure can tend to cause axial extrusion of the packer element. To reduce the tendency of axial extrusion, various packer anti-extrusion backup systems have been proposed in U.S. Pat. Nos. 7,661,471 and 7,806,193.

SUMMARY OF THE INVENTION

The present invention provides a well bore packer that includes a packer element and an anti-extrusion backup system, in which the anti-extrusion backup system includes a flexible mat. The packer element and the mat have a first or reduced diameter configuration when the packer element and backup system are assembled on a mandrel and inserted in the well bore. The packer element and the mat have a second or larger diameter configuration in which the packer element engages the wall of the well bore with sealing contact when the packer element is expanded. Expansion of the packer element self activates or expands the backup system.

Further, one region of the mat may be carried on an end region of the exterior peripheral surface of the packer element when the packer element is in its first or reduced diameter configuration. When the packer element expands to its second or larger diameter configuration, the expansion of the packer element may cause radial expansion of the one region of the mat while another region of the mat is not expanded and is secured against the mandrel. When this occurs, openings of the one region of the mat may change in size and the shape of the mat may change so that the mat may extend between the mandrel and the well bore wall. As sealing pressure of the packer element against the well bore wall increases, the expanded mat prevents axial extrusion of the packer element between the mandrel and the well bore wall.

Still further, the packer element may have a longitudinally extending shape with a central region and an end region. The backup system may include a flexible mat adjacent the packer element end region. The mat may have a plurality of elongated strands extending in different directions and intersecting in connected relationship to define a plurality of through openings. The mat may be in connected relationship with the end region of the packer element.

The one region of the mat may be in connected relationship with the end region of the packer element. The size of the openings of the one region of the mat may be larger when the mat is in its second configuration than when the mat is in its first configuration. The size of the openings of another region of the mat may be substantially the same when the mat is in its second configuration as when the mat is in its first configuration. The size of the openings of still another region of the mat may be of substantially the same size when the mat is in its first configuration and may be of various different sizes when the mat is in its second configuration. The regions of the mat may be generally cylindrical when the mat is in its first configuration, and the still other region of the mat may be generally conical when the mat is in its second configuration.

The mat may be a continuous wire mesh, and one region of the mat and the end region of the packer element may be disposed in longitudinally overlapping relationship. The central region of the packer element may have a nominal diameter, and the end region of the packer element may have a reduced diameter portion smaller than the nominal diameter of the central portion when the packer element is in its first and second positions. The one region of the mat may extend longitudinally substantially co-extensively with the reduced diameter end region of the packer element.

The anti-extrusion backup system may further include a rigid collar. The mat may be a continuous wire mesh or metallic wire mesh belt, and the mat may extend between the collar and the end region of the packer element. The mat regions may include a central region and longitudinally spaced end regions, and one of the end regions of the mat may extend longitudinally substantially co-extensively with the end region of the packer element. The other end region of the mat may extend longitudinally substantially co-extensively with a region of the collar. The central region of the mat may be generally cylindrical when the packer element and the mat are in their first configurations, and the central region of the mat may be generally conical when the packer element and the mat are in their second configurations. The packer element may be of an elastomeric swellable material, and swelling of the packer element may provide the sole means for displacing the mat from its first configuration to its second configuration.

A mandrel may have a longitudinally extending exterior surface, and the packer element and the mat may be disposed on the exterior surface of the mandrel. The packer element and the mat and the mandrel may be disposed in a well bore that has a well bore wall. The packer element and the mat may be radially spaced from the well bore wall when the packer element and the mat are in their first configurations. The packer element and an end region of the mat may engage the well bore wall when the packer element and mat are in their second configurations. Radial expansion of the packer element from its first configuration to its second configuration may provide the sole means for displacing the mat from its first configuration to its second configuration. The packer element may include another end region longitudinally spaced from the first mentioned packer element end region, and the backup system may include another flexible mat substantially identical to the first mentioned mat and disposed adjacent the other end region of the packer element.

The invention further provides method of expanding a packer backup system. The method includes the steps of mounting a backup system flexible mat intermediate a rigid collar and a tubular swellable packer element, with one end of the mat overlapping and being longitudinally coextensive with one end of the swellable packer element. The method may further include swelling the packer element by exposing the packer element to a swelling fluid, and causing radial expansion of the one end of the mat solely by means of the swelling of the packer element.

The invention further provides various ones of the features and structures described above and in the claims set out below, alone and in combination, and the claims are incorporated by reference in this summary of the invention.

BRIEF DESCRIPTION OF THE DRAWINGS

Embodiments of this invention will now be described in further detail with reference to the accompanying drawings, in which.

DETAILED DESCRIPTION OF THE INVENTION

The principles, embodiments and operation of the present invention are shown in the accompanying drawings and described in detail herein. These drawings and this description are not to be construed as being limited to the particular illustrative forms of the invention disclosed. It will thus become apparent to those skilled in the art that various modifications of the embodiments herein can be made without departing from the spirit or scope of the invention.

Figure 1:
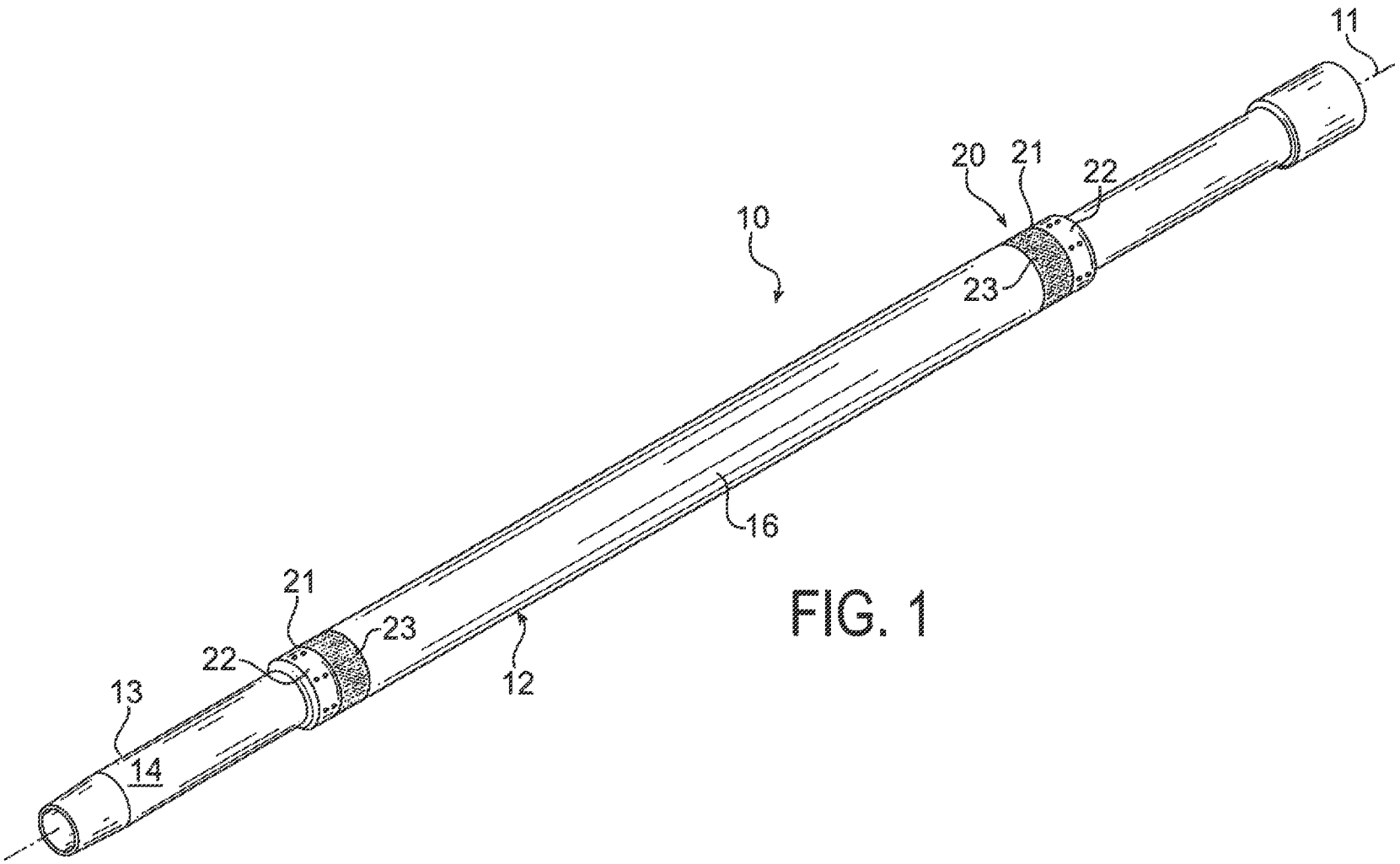
FIG. 1 is a perspective view of a well bore packer according to principles of the present invention, shown in a first or radially inward configuration.
Figure 2:
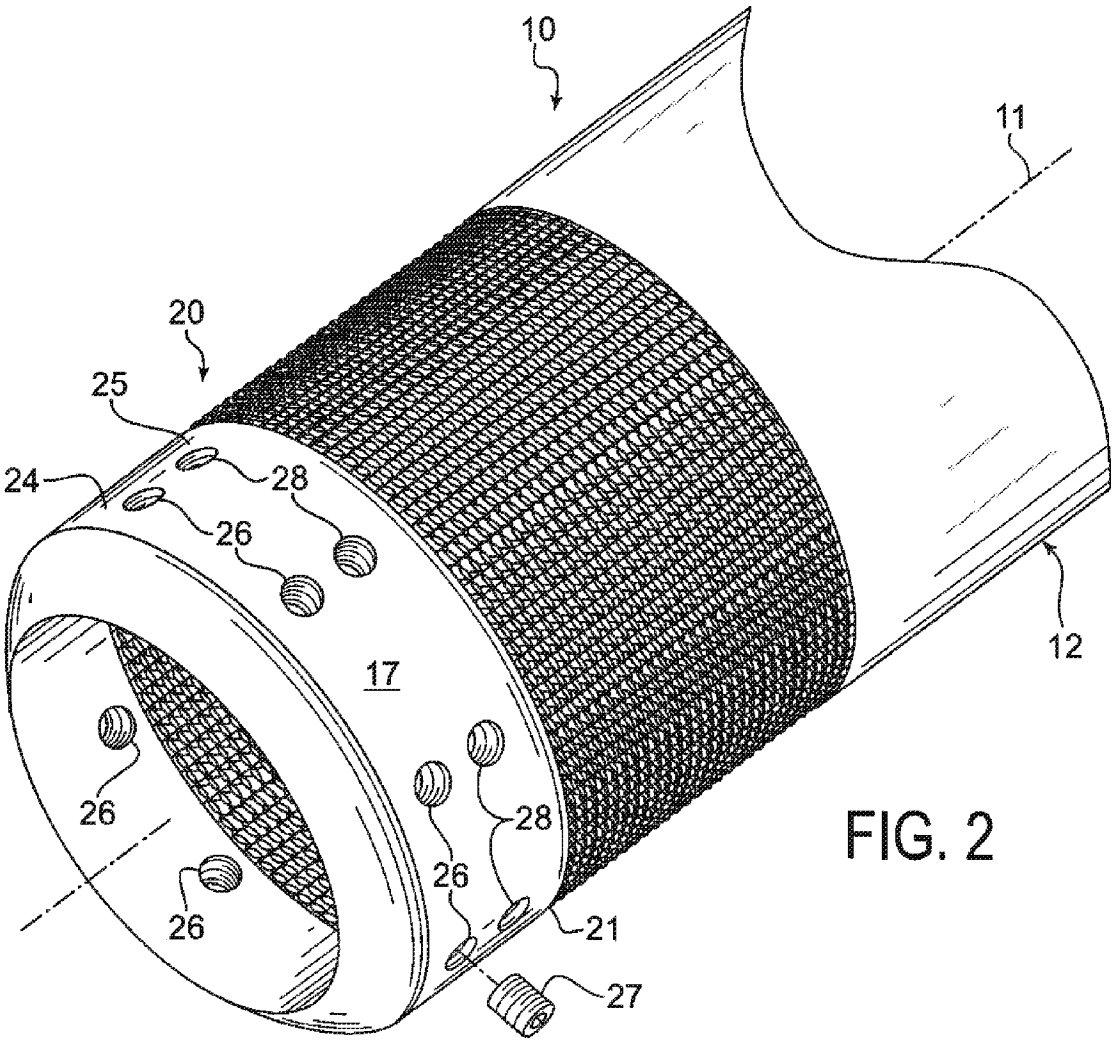
FIG. 2 is an enlarged perspective view of one end of the packer illustrated in FIG. 1, with the mandrel removed for clarity.
Figure 3:
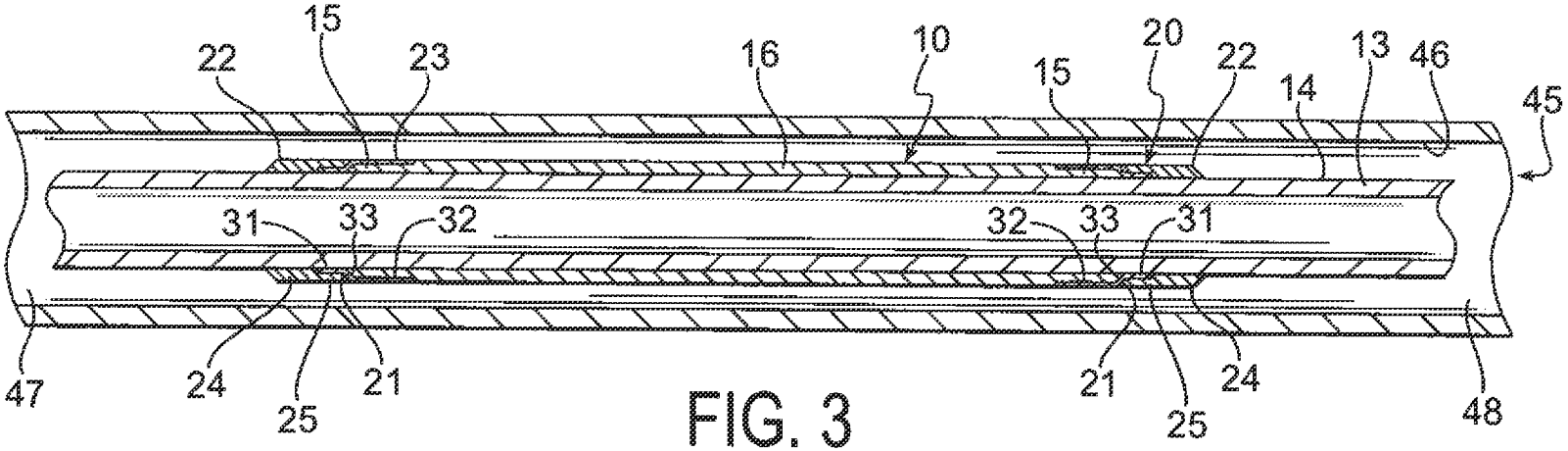
FIG. 3 is a cross sectional view of the packer of FIG. 1 assembled in a well bore, with the packer element in the first or radially inward configuration.
Figure 4:
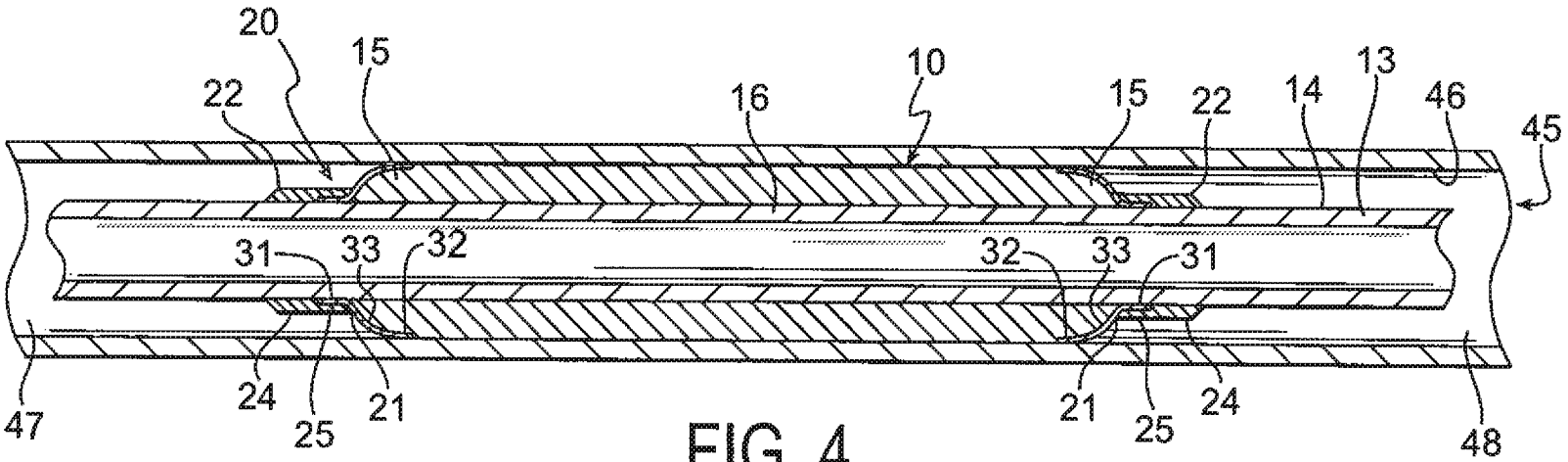
FIG. 4 is a cross sectional view of the packer of FIG. 1 assembled in a well bore, with the packer element in a second or radially outward configuration.

Referring now to the drawings in greater detail, FIGS. 1-4 illustrate a well bore packer 10 having a longitudinal axis 11. The packer 10 includes an elastomeric polymeric packer element 12 having a generally tubular longitudinally extending shape or configuration. A rigid metallic longitudinally extending mandrel 13 has a generally cylindrical exterior or radially outwardly facing surface 14, and the packer element 12 is disposed on the exterior surface 14. The packer element 12 is preferably of a swellable material. The swellable material may be any desired swellable material suitable for use in a well bore, such as for example nitrile or nitrile butadiene rubber (NBR) or highly saturated nitrile (HNBR) with suitable swelling agents. Alternatively, other suitable materials may include swellable or nonswellable thermoplastic or thermosetting or composite or blend materials selected according to the pressures, temperatures, fluids and other factors of the environment in which the packer 10 is intended to be used. The packer element 12 may be manufactured according to the process disclosed in United States patent application number 2008/0011488 A1, the entirety of which is incorporated herein by reference, and may be bonded to the mandrel 13. Alternatively, the packer element 12 may be manufactured using other methods such as, for example, molding or mandrel wrapping. The packer element 12 includes longitudinally spaced end regions 15 and a central region 16 as best illustrated in FIGS. 3 and 4. The central region 16 has an average nominal external diameter, and the end regions 15 are of reduced diameter relative to the diameter of the central region 16.

The packer 10 further includes an anti-extrusion backup system 20 having substantially identical anti-extrusion devices 21 disposed at each of the ends 15 of the packer element 12, to provide extrusion resistance on both ends of the packer element 12. The anti-extrusion devices 21 each include an end collar 22 and a flexible mat 23. The end collars 22 are generally cylindrical and have a first generally cylindrical portion 24 and a second generally cylindrical portion 25. A plurality of radially extending through holes 26 extend through the first cylindrical portion 24 and are aligned with the exterior surface 14 of the mandrel 13. The holes 26 are threaded, and set screws 27 (one of which is illustrated in FIG. 2) are received in the threaded holes 26 and are tightened firmly against the exterior surface 14 of the mandrel 13 to secure the end collars 22 against movement relative to the mandrel 13. Alternatively, the end collars 22 may be securely mounted to the mandrel 14 using other methods such as welding. A plurality of other radially extending through holes 28 extend through the second cylindrical portion 25 and are longitudinally spaced from the holes 26. The holes 28 are also threaded and receive set screws 19. The second cylindrical portion 25 of the collar 22 has an enlarged internal diameter.

The flexible mat 23 includes longitudinally spaced end regions 31 and 32 and a central portion 33. The end regions 31 and 32 are substantially cylindrical, with the end region 31 being of smaller diameter than the end region 32. The smaller diameter end region 31 of the mat 23 is disposed between and is captured between the enlarged internal diameter of the second cylindrical portion 25 of the collar 15 and the exterior surface 14 of the mandrel 13. The set screws 19 that extend through the holes 28 tightly engage the end region 31 of the mat 23 and force the end region 31 against the exterior surface 14 to secure the end region 31 in place relative to the mandrel 13 and collar 22. The larger diameter end region 32 of the mat 23 is radially aligned with and is axially coextensive with the smaller diameter end region 15 of the packer element 12. The difference between the outside radius of the smaller diameter end region 15 of the packer element 12 and the outside radius of the central region 16 of the packer element 12 is substantially equal to the radial thickness of the mat 23, so that the outer peripheral surfaces of the collars 22 and mat region 32 and packer element central region 16 are generally longitudinally substantially smooth or uninterrupted when the packer is in its configuration illustrated in FIGS. 1-3, to facilitate longitudinal insertion of the packer 10 into a well bore as further described below. If the packer element 12 is made of an alternative nonswellable material as mentioned above, the end collars 22 illustrated in the drawings may be replaced with other suitable end collars such as, for example, end collars that may move longitudinally relative to the mandrel 13 to longitudinally compress and thereby radially expand the packer element.

Figure 5:
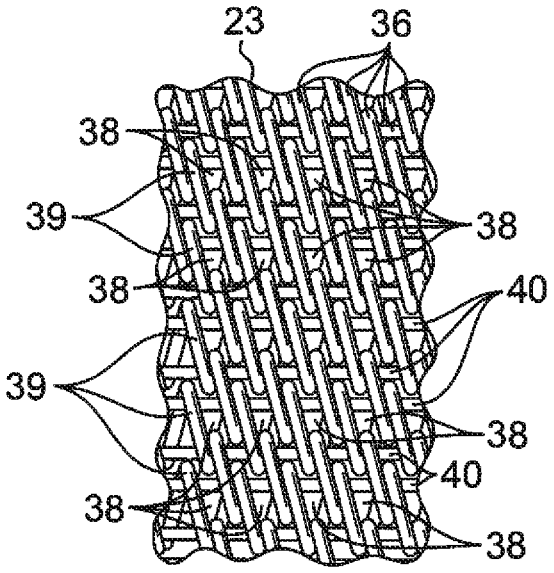
FIG. 5 is a partial view of the mat used in the packer of FIG. 1, with the mat of the packer illustrated in its first or radially inward configuration.

A portion of the end regions 31 and 32 and central region 33 of the mats 23 in the first or smaller diameter configuration is illustrated in FIG. 5 and is enlarged for clarity. The mats 23 include a plurality of elongated strands 36 extending in different directions and intersecting in interlocking relationship to define a plurality of radial through openings 38 of predetermined geometric shape and size. The configuration of the strands 36 illustrated in FIG. 5 is preferably that of a known wire mesh conveyor belt in which the strands 36 include wire spirals 39 joined by wire rods 40 as further described at the internet websites meshbelt.com and lumsdencorp.com. The material of the strands 36 is preferably high strength steel or stainless steel having a wire diameter in the range of 33 gauge (0.010 inch diameter) to 0 gauge (0.324 inch diameter). Alternatively, other strand configurations, strand cross sectional shapes, weave configurations and sizes, and strand materials may be used for the mat 23. Also, the strands may be configured as chainmail or may be formed from a single piece of material by cutting or punching to form the openings 38.

Figure 6:
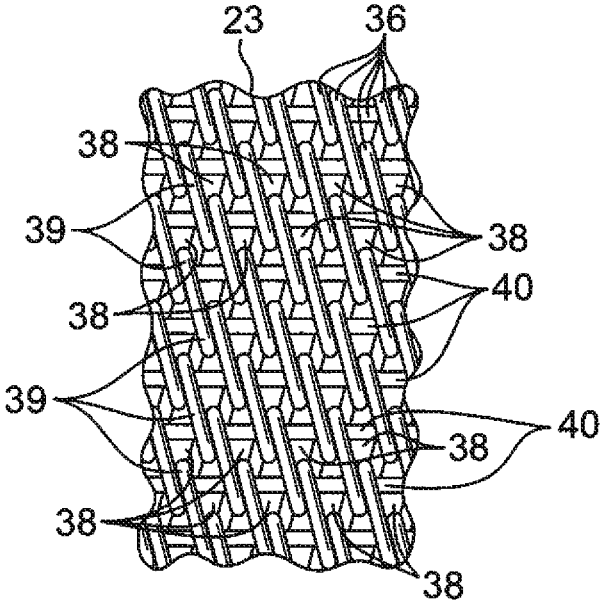
FIG. 6 is a partial view of the mat used in the packer of FIG. 1, with the mat of the packer illustrated in its second or radially outward configuration.

Referring now to FIG. 3, the packer 10 is assembled in a well bore 45 having a well bore wall 46. The well bore wall 46 may be a cased well bore wall or an open well bore wall, and in the embodiment illustrated in the drawings the wall 46 is a casing wall. The mandrel 13 is longitudinally inserted into the well bore 45 to a position illustrated in FIG. 3 at which it is desired to block fluid communication between well bore region 47 and well bore region 48. The packer 10 in FIG. 3 is in a first or un-swelled or radially inward configuration, and fluid communication between well bore regions 47 and 48 is open. In this configuration, the outside diameter or radial extent of the outer peripheral portions of the collars 22 and mats 23 and central region 16 of packer element 12 are substantially the same, to facilitate insertion of the packer 10 into the well bore 45. When it is desired to activate the packer 10, a known swelling fluid is communicated to the packer element 12 to cause the swellable material of the packer element 12 to swell or expand radially outwardly. Because the mat regions 32 and 33 (FIGS. 3 and 4) that cover the end regions 15 of the packer element 12 have holes 38 (FIGS. 5 and 6), the end regions 15 are exposed to the swelling fluid through the holes 38. Continued outward expansion of the packer element 12 causes the central region 16 of the packer element 12 and the larger diameter end regions 32 of the mats 23 to engage the well bore wall 46 in the second or expanded configuration illustrated in FIG. 4. As the packer element 12 continues to try to swell or expand further radially outwardly, such continued radial expansion is contained by the well bore wall 46 so that the central region 16 of the packer element 12 exerts a substantial pressure against the well bore wall 46 to prevent fluid communication between and isolate well bore region 47 from well bore region 48. Further, the swelling or expansion of the end regions 15 of the packer element 12 that are axially coextensive with the end regions 32 of the mat 23 pushes or carries the end regions 32 of the mat 23 radially outwardly and tightly against the well bore wall 46 to activate or deploy the anti-extrusion devices 21. The increased radially outward pressure caused by the swelling or expansion of the packer element 12 causes the packer element 12 to try to extrude longitudinally into the annular area between the outer peripheral surface of the collars 22 and the well bore wall 46. This longitudinal extrusion is prevented by the activated anti-extrusion devices 21. The smaller diameter end region 31 of the mat 23 remains secured against the mandrel 13 by the collars 22 and set screws 19 described above, and the larger diameter end region 32 of the mat 23 remains secured against the well bore wall 46 by the end regions 15 of the packer element 12. The central region 33 of the mat 23 is displaced by swelling or expansion of the packer element 12 from its first generally cylindrical configuration illustrated in FIG. 3 to a generally conical configuration illustrated in FIG. 4, in which the central region 33 extends between the mandrel 13 and the well bore wall 46 to create a barrier that substantially precludes the packer element 12 from extruding longitudinally between the collars 22 and the well bore wall 46. In this manner, the anti-extrusion back up system 20 is activated by and deployed into position by and held in position solely by the swelling or expansion of the packer element 12. This activation requires no additional external force or activation step. Further increased radially outward pressure of the packer element 12 tends to hold the larger diameter portion 32 of the mat 23 tighter against the well bore wall 46.

When the packer 10 is in its first or smaller diameter position illustrated in FIG. 1-3 and before the packer 10 begins its swelling or expansion to its second or larger diameter configuration illustrated in FIG. 4, the geometric shape and size of the openings 38 in the mat 23 are substantially are in a configuration illustrated in FIG. 5. As the packer 10 swells or expands to its larger size illustrated in FIG. 4, the size of the openings 38 in the smaller diameter end region 31 of the mat remain of the size illustrated in FIG. 5 while the size of the openings 38 in the larger diameter end region 32 substantially change or become substantially different from the openings in the smaller diameter end region 31 and increase to the size illustrated in FIG. 6. The size of the openings 38 in the central region 33 of the mat 23 as this occurs also substantially changes and will vary in size from the smaller size openings near the end region 31 to the larger size openings near the end region 32.

Presently preferred embodiments of the invention are shown in the drawings and described in detail above. The invention is not, however, limited to these specific embodiments. Various changes and modifications can be made to this invention without departing from its teachings, and the scope of this invention is defined by the claims set out below.

What is claimed is:

1. A well bore packer comprising a swellable packer element and an anti-extrusion backup system, the swellable packer element being swellable from a first configuration to a second swollen configuration by exposure to a swelling fluid, the packer element having a longitudinally extending shape with a central region and an end region, and the backup system including a flexible mat having an axially inner region surrounding the packer element end region and an axially outer region, and a collar in axial overlapping relationship with the axially outer region of the flexible mat for restraining radial expansion of the axially outer region of the flexible mat when the swellable packer element swells to the second swollen configuration by exposure to the swelling fluid, and the mat having a plurality of elongated strands that (i) extend in different directions and intersect in connected relationship to define a plurality of through openings and that (ii) allow for radial expansion of the axially inner region of the flexible mat from a contracted configuration to an expanded configuration along with the end region of the swellable packer element when the swellable packer element is exposed to the swelling fluid.

2. The packer as set forth in claim 1, wherein the mat is in connected relationship with the end region of the packer element.

3. The packer as set forth in claim 1, wherein the openings of the axially outer region of the mat have a size substantially the same as the size of the openings in the axially inner region of the mat when the axially inner region is in the contracted configuration.

4. The packer as set forth in claim 1, wherein the axially inner and outer regions of the mat are generally cylindrical when the axially inner region of the mat is in the contracted configuration, and the axially inner region of the mat is generally conical when in the expanded configuration.

5. The packer as set forth in claim 4, wherein the mat has an axially innermost end region surrounding the swellable packer element and which has a cylindrical configuration when the axially inner region of the mat is in the contracted and expanded configurations.

6. The packer as set forth in claim 1, wherein the central region of the swellable packer element has a nominal external diameter, and the end region of the swellable packer element has a reduced diameter corresponding to a thickness of the mat such that an outer surface of the mat is flush with an axially adjacent outer surface of the swellable packer element.

7. The packer as set forth in claim 1, wherein radially outwardly surrounds the axially outer region of the mat.

8. The packer as set forth in claim 7, wherein mat further has an axially innermost end region, and the axially innermost end, axially inner and axially outer regions are generally cylindrical when the swellable packer element is in the first configuration, and the axially inner region of the mat is generally conical when the swellable packer element is in the swollen configuration.

9. The packer as set forth in claim 1, wherein the packer element is made of an elastomeric swellable material.

10. The packer as set forth in claim 1, including a mandrel having a longitudinally extending exterior surface, and the packer element and the mat are disposed on the exterior surface of the mandrel.

11. The packer as set forth in claim 1, including a mandrel having an longitudinally extending exterior surface, the packer element and the mat are disposed on the exterior surface of the mandrel, the packer element and the mat and the mandrel are disposed in a well bore that has a well bore wall, the packer element and the mat are radially spaced from the well bore wall when the packer element is in the first configuration, the packer element and an innermost end region of the mat engage the well bore wall when the packer element is in the swollen configuration.

12. The packer as set forth in claim 1, wherein the packer element includes another end region longitudinally spaced from the first mentioned packer element end region, and a second said backup system at the other end region of the packer element.

13. A method of expanding a packer in a well bore hole, comprising inserting the packer of claim 1 in the well bore, and swelling the packer element by exposing the packer element to a swelling fluid.

14. A well bore packer comprising a packer element and an anti-extrusion backup system, the packer element being radially expandable from a radially contracted configuration to a radially expanded configuration, the packer element having a longitudinally extending shape with a central region and opposite first and second end regions, and the backup system including a flexible mat having an axially inner region surrounding the first end region and an axially outer region extending axially outwardly beyond the first end region, and a collar in axial overlapping relationship with the axially outer region of the flexible mat for restraining radial expansion of the axially outer region of the flexible mat when the packer element is expanded from the radially contracted configuration to the radially expanded configuration, and the mat having a plurality of elongated strands in the form of wire spirals and wire rods joining the wire spirals to form a wire mesh belt.

15. The well bore packer of claim 14, wherein the mat is cylindrical when the packer element is in the radially contracted configuration.

16. The well bore packer of claim 15, wherein a portion of the mat radially expands to a conical configuration when the packer element is expanded to the radially expanded configuration.

17. The well bore packer of claim 15, further comprising a second said backup system at the second end region.

18. The well bore packer of claim 17, further comprising a mandrel extending longitudinally through the packer element and backup systems, and the collars of the backup systems are fixed against axial movement relative to the mandrel.

* * * * *